US008227765B2

(12) United States Patent
Syms

(10) Patent No.: US 8,227,765 B2
(45) Date of Patent: Jul. 24, 2012

(54) ELECTROSPRAY PNEUMATIC NEBULISER IONISATION SOURCE

(75) Inventor: Richard Syms, London (GB)

(73) Assignee: Microsaic Systems PLC, Working, Surrey (GB)

( * ) Notice: Subject to any disclaimer, the term of this patent is extended or adjusted under 35 U.S.C. 154(b) by 221 days.

(21) Appl. No.: 12/823,318

(22) Filed: Jun. 25, 2010

(65) Prior Publication Data

US 2011/0000986 A1 Jan. 6, 2011

(30) Foreign Application Priority Data

Jul. 3, 2009 (GB) ..... 0911554.4

(51) Int. Cl.
*F23D 11/00* (2006.01)
*F23D 11/32* (2006.01)
*H01J 49/04* (2006.01)

(52) U.S. Cl. ..... 250/425; 250/281; 250/282; 250/284; 250/286; 250/288; 250/306; 250/423 R; 250/522.1

(58) Field of Classification Search ..... 250/281, 250/282, 284, 286, 288, 306, 423 R, 425, 250/522.1
See application file for complete search history.

(56) References Cited

U.S. PATENT DOCUMENTS

| | | | |
|---|---|---|---|
| 4,746,068 A | 5/1988 | Goodley et al. | |
| 5,115,131 A | 5/1992 | Jorgenson et al. | |
| 5,501,893 A | 3/1996 | Larmer et al. | |
| 5,788,166 A | 8/1998 | Valaskovic et al. | |
| 5,975,426 A | 11/1999 | Myers | |
| 6,231,737 B1 | 5/2001 | Ramsey et al. | |
| 6,297,499 B1 | 10/2001 | Fenn | |
| 6,454,193 B1 | 9/2002 | Busick et al. | |
| 6,478,238 B1 | 11/2002 | Wachs et al. | |
| 6,516,604 B2 | 2/2003 | Mojarradi et al. | |
| 6,723,985 B2 | 4/2004 | Schultz et al. | |
| 6,831,274 B2 | 12/2004 | Smith et al. | |
| 6,992,299 B2 | 1/2006 | Lee et al. | |
| 7,081,622 B2 | 7/2006 | Kameoka et al. | |
| 7,141,807 B2 | 11/2006 | Joyce et al. | |
| 7,517,479 B2 * | 4/2009 | Bango et al. | 264/10 |
| 7,863,581 B2 * | 1/2011 | Lozano et al. | 250/423 R |
| 7,932,492 B2 * | 4/2011 | Demmons et al. | 250/288 |
| 8,030,621 B2 * | 10/2011 | Lozano et al. | 250/423 R |
| 8,063,362 B1 * | 11/2011 | Dressler et al. | 250/289 |
| 2004/0067578 A1 | 4/2004 | Axelsson | |

(Continued)

FOREIGN PATENT DOCUMENTS

WO WO/00/64591 11/2000

OTHER PUBLICATIONS

Gaskell, S.J. "Electrospray: Principles and practice" J. Mass Spect. 32, 677-688 (1997).

(Continued)

*Primary Examiner* — David A Vanore
(74) *Attorney, Agent, or Firm* — Bishop & Diehl, Ltd.

(57) ABSTRACT

This invention provides a method of combining an array-type nanospray ionization source comprising a set of externally wetted proud features and a contact electrode with a pneumatic nebuliser acting to enhance the flux of sprayed ions. Methods of fabricating a substrate combining a set of proud features with analyte delivery and gas flow channels in silicon-based materials are described.

29 Claims, 7 Drawing Sheets

U.S. PATENT DOCUMENTS

| | | | | |
|---|---|---|---|---|
| 2004/0206399 | A1 | 10/2004 | Heller et al. | |
| 2009/0032724 | A1 | 2/2009 | Lozano et al. | |
| 2010/0025575 | A1* | 2/2010 | Demmons et al. | 250/288 |
| 2011/0000986 | A1* | 1/2011 | Syms | 239/690 |

OTHER PUBLICATIONS

Wachs, T., Henion J. "Electrospray device for coupling microscale separations and other miniaturized devices with electrospray mass spectrometry" Anal. Chem. 73, 632-638 (2001).

Wilm, M., Mann, M. "Analytical properties of the nanoelectrospray ion source" Anal. Chem. 68,1-8 (1996).

Ramsey R., Ramsey J."Generating electrospray from microchip devices using electro-osmotic pumping" Anal. Chem. 69, 1174-1178 (1997).

Ramsey J.M., Ramsey, R.S. "Material transport method and apparatus" US 6,231,737 Nov. 16, 1999.

Schultz G.A., Corso T.N., Prosser S.J., Zhang S. "A fully integrated monolithic microchip electrospray device for mass spectrometry" Anal. Chem. 72, 4058-4063 (2000).

Tang K., Lin Y., Matson D.W., Kim T., Smith R.D. "Generation of multiple electrosprays using micro-fabricated emitter arrays for improved mass spectrometric sensitivity" Anal. Chem. 73, 1658-1663 (2001).

Zhang B., Liu H., Karger B.L., Foret F. "Micro-fabricated devices for capillary electrophoresis-electrospray mass spectrometry" Anal. Chem. 71, 3258-3264 (1999).

Syms R.R.A., Zou H., Bardwell M., Schwab M.-A. "Microengineered alignment bench for a nanospray ionisation source" J. Micromech. Microeng. 17, 1567-1574 (2007).

Mueller J. "Thruster options for microspacecraft: a review and evaluation of existing hardware and emerging technologies" AIAA 97-3058 (1997).

Mueller J., Marrese C., Ziemer J., Green A., Yang E.-H., Mojarradi M., Johnson T., White V., Barne D. "JPL micro-thrust propulsion activities" AIAA-2002-5714 (2002).

Kameoka J., Orth R., Czaplewski D., Wachs T., Craighead H.G. "An electrospray ionization source for integration with microfluidics" Anal. Chem. 74, 5897-5901 (2002).

Lozano P., Marinez-Sanchez M. Ionic liquid ion sources: characterization of externally wetted emitters' J. Colloid Sci. 282, 415-421 (2005).

Garza T.G., Lozano P., Velasquez-Garcia L.F., Sanchez M.M. "The characterization of silicon wettability and properties of externally wetted micro-fabricated electrospray thruster arrays" Proc. 29th IEPC, Princeton, Oct. 31-Nov. 4, Paper 195 (2005).

Velasquez-Garcia L.F., Akinwande A.I., Martinez-Sanchez M. "A micro-fabricated linear array of electrospray emitters for thruster applications" J. Microelectromech. Syst. 15, 1260-1271-1280 (2006a).

Velasquez-Garcia L.F., Akinwande A.I., Martinez-Sanchez M. "A planar array of micro-fabricated electrospray emitters for thruster applications" Microelectromech. Syst. 15, 1272-1280 (2006b).

Gassend B.L.P., Velasquez-Garcia L.F., Akinwande A.I., Martinez-Sanchez M. "Fabrication of a fully integrated electrospray array with applications to space propulsion" Proc. MEMS 2008, Tucson, AZ, Jan. 13-17, pp. 976-979 (2008).

Ji J., Tay F.E.H., Miao J., Sun J. "Characterization of silicon isotropic etch by inductively coupled plasma etcher for silicon microneedle array fabrication" J. Phys. Conf. Ser. 34, 1137-1142 (2006).

Lorenz H., Despont M., Fahrni N., Labianca N., Renaud P., Vettinger P. "SU-8: a low-cost negative resist for MEMS" J. Micromech. Microeng. 7, 121-124 (1997).

Hynes A.M., Ashraf H., Bhardwaj J.K., Hopkins J., Johnston I., Shepherd J.N. "Recent advances in silicon etching for MEMS using the ASETM process" Sensors and Actuators 74, 13-17 (1999).

Robbins H., Schwartz B. "Chemical etching of silicon. I. The system HF, HNO3 and H2O" J. Electrochem. Soc. 106, 505-508 (1959).

Lee D.B. "Anisotropic etching of silicon" J. Appl. Phys. 40, 4569-4574 (1969).

Van Den Meerakker J.E.A.M., Elfrink R.J.G., Roozeboom F. "Anodic silicon etching: the formation of uniform arrays of macropores or nanowires" Phys. Stat. Sol a 197, 57-60 (2003).

Jansen H., De Boer M., Legtenberg R., Elwenspoek M. "The black silicon method: a universal method for determining the parameter setting of a fluorine-based reactive ion etcher in deep silicon trench etching with profile control" J. Micromech. Microeng. 5, 115-120 (1995).

British Search Report from priority application No. GB0911554.4.

* cited by examiner

ELECTROSPRAY PNEUMATIC NEBULISER IONISATION SOURCE

CROSS-REFERENCE TO RELATED APPLICATIONS

This application claims the benefit of United Kingdom Patent Application Serial No. GB0911554.4 filed on Jul. 3, 2009.

TECHNICAL FIELD OF THE INVENTION

This invention relates to an electrospray pneumatic nebuliser ionisation source and in particular to the provision of a micro-fabricated nanospray ion source that may enhance the spray from a number of externally wetted proud features using a pneumatic nebuliser. In a preferred application such a source may be used in the context of mass spectrometry.

BACKGROUND OF THE INVENTION

Electrospray is a popular method of soft ionisation in mass spectrometry, since it allows the analysis of fluid samples pre-separated by liquid chromatography or capillary electrophoresis, the ionization of complex molecules without fragmentation, and a reduction in the mass-to-charge ratio of heavy molecules by multiple charging [Gaskell 1997].

The principle of electrospray is simple. A voltage is applied between an electrode typically consisting of a diaphragm containing an orifice and a capillary needle containing a liquid analyte. Liquid is extracted from the capillary tip and its free surface is drawn into a Taylor cone, from which large charged droplets are emitted. The droplets are accelerated to supersonic speed, evaporating as they travel. Coulomb repulsion of the charges in the shrinking droplet results in fragmentation to ions when the Rayleigh stability limit is reached. The resulting ions can be multiply charged.

Additional methods are used to promote a well-dispersed spray of small droplets and hence a concentrated flow of analyte ions. Often these are based on pneumatic nebulisation by a coaxial gas stream, and a variety of pneumatic nebulisers have been demonstrated [U.S. Pat. No. 4,746,068; Wachs 2001; U.S. Pat. No. 6,478,238]. Aerodynamic effects such as the Coanda and Venturi effects are also used to improve the efficiency of ion transmission towards the inlet of a subsequent analyser such as a mass spectrometer [WO 00/64591; U.S. Pat. No. 6,992,299].

In a conventional electrospray system, with capillaries of around 100 microns internal diameter, flow rates are of the order of 1 micro-litre per minute, and extraction voltages lie in the range 2.5 kV-4 kV. Flow rates and voltages are considerably reduced in so-called "nanospray systems" [Wilm 1996], based on capillaries having internal diameters ranging down to around 5 micron [U.S. Pat. No. 5,115,131; U.S. Pat. No. 5,788,166]. Decreasing the capillary diameter and lowering the flow rate also tends to create ions with higher mass-to-charge ratio.

Considerable progress has been made in integrating nanospray ionisation sources with chip-based separation devices. For example, an ion spray can be drawn from the edge of a glass chip containing a capillary electrophoretic separator [Ramsey 1997; U.S. Pat. No. 6,231,737]. Since then, similar sources have been demonstrated in many materials, especially plastics. Geometries in which the analyte flows through a capillary etched perpendicular to the surface of a silicon chip have also been demonstrated [Schultz 2000; U.S. Pat. No. 6,723,985]. Such devices may be formed into two-dimensional arrays, and it has been shown they can provide an increased ion-flux based on the ion streams derived from many separate nanospray sources [Tang 2001, U.S. Pat. No. 6,831,274]. Nebulisers have also been provided for chip-based nanospray sources, for use with integrated capillaries [Zhang 1999] and with inserted capillaries [Syms 2007]. However, pneumatic nebulisers have not so far been used with array-type sources, reducing the potential advantage of the use of an array.

Capillary electrospray sources have also been considered for use in so-called colloidal thrusters, a method of micro-propulsion or attitude adjustment of spacecraft based on the ejection of ions from capillaries [Mueller 1997; Muller 2002]. In some cases the devices have been micro-fabricated in silicon [U.S. Pat. No. 6,516,604].

The use of a capillary with a small internal diameter as a source for nanospray suffers from a number of disadvantages. These include the difficulty of fabricating suitably fine features, especially in an integrated device, the likelihood of clogging of such features by particulate matter or deposits, and problems with matching flow rates to pre-separation sources of liquid analyte such as liquid chromatography systems.

One solution to the problem of forming and using a capillary source with a very small internal diameter is to include a porous bead inside a larger capillary at its tip [U.S. Pat. No. 5,975,426]. Similarly, one solution to the problem of flow rate matching is to include inside the capillary a wick element containing an aggregate of parallel, wettable fibers [U.S. Pat. No. 6,297,499] or nanowires [U.S. Pat. No. 7,141,807].

While these solutions purport to address the aforementioned problems there is still a need for improved ionisation sources.

SUMMARY OF THE INVENTION

These and other problems are addressed in accordance by the present teaching by providing an electrospray pneumatic nebuliser ionisation source. Such a source combines a pneumatic nebuliser with emitters, such as nanospray emitters, to provide a high-flux ion source for liquid analytes, something that has particular application mass spectrometry.

The pneumatic nebuliser is desirably provided as a coaxial nebuliser that is combined with a two dimensional array of externally wetted nanospray emitters. Such a plurality of emitters are desirably configured and arranged relative to one another such that each emitter acts as an independent emitter—the array thereby being formed from a plurality of individual emitters. In a preferred arrangement such a device is provided using planar fabrication methods.

The use of a pneumatic nebuliser improves dispersion of the spray and hence provides an enhanced ion flux.

In a first arrangement, an array of externally wetted nanospray emitters with a pneumatic nebuliser is provided. Such an array may be constructed by reactive plasma etching of the front side of a silicon substrate to form a set of proud features, features that are upstanding from the surface of the silicon substrate. The silicon surface may then be surface treated, for example by coating it with a silicon dioxide layer, to allow wetting by a liquid analyte so as to flow over the proud features. In a first arrangement, the liquid can be delivered directly to the front of the substrate. In another arrangement, the liquid could be delivered through the substrate onto the proud features using for example an etched hole or channel provided within the substrate.

Conducting surface electrodes are typically provided to allow electrical contact to the liquid. To confine the provided liquid to defined areas of the substrate, typically that region about the proud features, a hydrophobic barrier may be provided.

Electrospray may be carried out using a potential difference applied between the surface electrode and an external electrode. The form of the generated spray may be enhanced through use of a nebuliser gas. Typically this is delivered by providing a channel etched around the emitter array so as to allow a nebuliser gas to pass through the substrate and provide a concentric gas flow around the flux of electrosprayed ions.

Accordingly there is provided a device as claimed in claim 1. Advantageous embodiments are provided in the claims thereto.

These and other features and advantages relating to an exemplary arrangement provided in accordance with the present teaching will be better understood with reference to the following figures:

BRIEF DESCRIPTION OF THE DRAWINGS

FIG. 5 shows a section view along the line A-A' of a fabrication process for forming an array of externally wetted proud features for electrospray emission, wherein

FIG. 6 shows a section view along the line A-A' of a fabrication process for forming a conducting surface electrode, wherein FIG. 6A illustrates step 4 of the process, FIG. 6B illustrates step 5 of the process, and FIG. 6C illustrates step 6 of the process.

FIG. 7 shows a section view, along the line A-A' of a fabrication process for forming a gas flow channel and a liquid flow channel, wherein FIG. 7A illustrates step 7 of the process, FIG. 7B illustrates step 8 of the process. FIG. 7C illustrates step 9 of the process, and FIG. 7D illustrates step 10 of the process.

DETAILED DESCRIPTION

Figure 1:
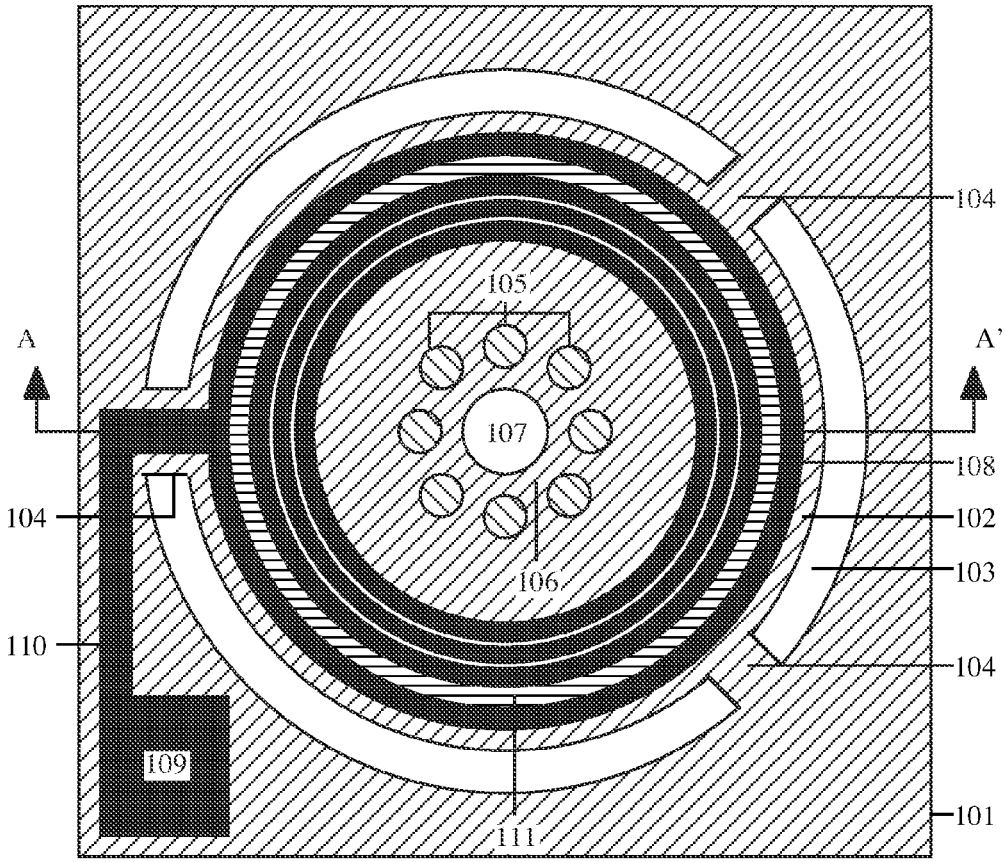
FIG. 1 shows a plan view of a micro-fabricated externally wetted electrospray ionisation source with an integrated pneumatic nebuliser.

An exemplary arrangement provided to assist in an understanding of the present teaching will now be described with reference to FIGS. 1 to 4. FIG. 1 shows a plan view of a micro-fabricated externally wetted electrospray ionisation source with an integrated pneumatic nebuliser, according to this exemplary arrangement. The device is formed in a planar substrate 101. It will be appreciated that fabrication using standard micro-fabrication techniques is advantageous. So as to allow for the use of standard micro-fabrication processes, the substrate material is desirably silicon which may be coated in a hydrophilic layer to allow wetting by aqueous solutions. Suitable hydrophilic surface coatings include silicon dioxide, but it will be understood that it is not intended to limit the present teaching to such treatments.

A central table 102 is formed in and on a first side of the substrate by etching a slot 103 through the substrate to form a perimeter that almost completely surrounds the table, allowing the table to remain attached to the substrate by a number of narrow sections of material 104. The etched slot 103 provides a channel from the rear of the substrate to the front of the substrate, through which gas may subsequently flow, while the narrow sections 104 provide a mechanical support for the central table against the gas flow.

The central table carries a number of proud features 105, each proud feature being formed by etching the first side, which may be considered a front side, of the substrate. Each of the proud features desirably form an individual emitter. The shape of each feature is desirably such as to allow for efficient generation of an electrospray which is desirably effected by externally wetting each of the provided emitters. In practise, the height of the proud features will be limited to around 100 microns, and the diameter of each proud feature at its tip will be chosen so that the resulting emitter can operate in the nanospray flow regime, typically 1 micron-50 micron.

In operation it is desirable for the proud features to have a liquid coating so as to have a wettable surface. Such a liquid 106 (here, presumed to be a liquid analyte) may be provided to coat the hydrophilic surface in the vicinity of the table centre and arising from the geometrical construction of the device will also flow over the proud features 105. The liquid 106 may be delivered directly to the front side of the substrate as described below or from a second side, in this case the rear side, of the substrate via an additional hole 107 etched right through the substrate.

Electrical contact to the liquid is provided by a conducting surface electrode 108 on the front side of the substrate, which is connected to a contact pad 109 on the substrate 101 by a section of conducting track 110 desirably passing over one of the short sections of material 104. Suitable conducting materials include noble metals such as gold, or other materials as will be appreciated by those of ordinary skill in the art If the conducting surface electrode 108 is hydrophobic and provided in the geometry of a closed ring, it may act as a confining barrier to prevent unwanted flow of liquid over the remainder of the substrate. Alternatively, a confining liquid barrier may easily be provided using a ring of an alternative hydrophobic material 111. Suitable barrier materials include hydrophobic polymers.

Figure 2:
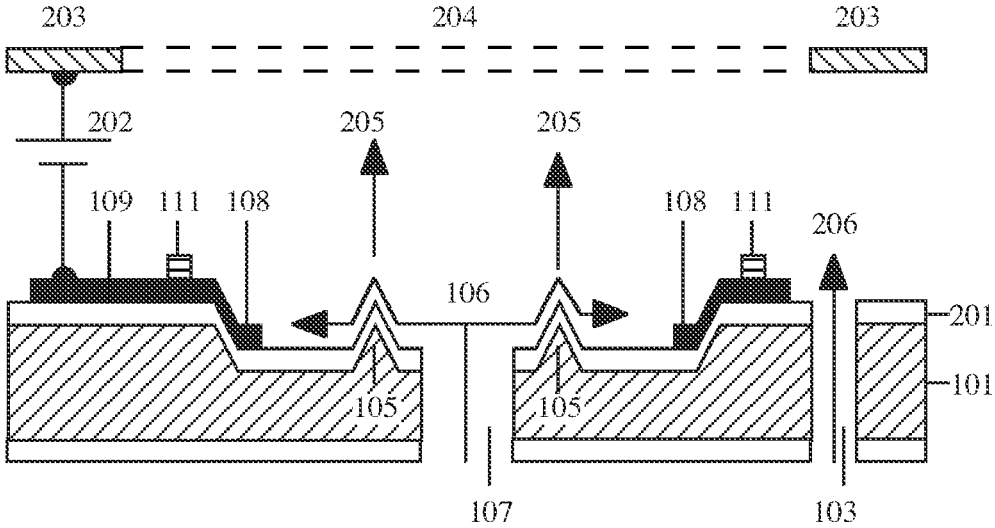
FIG. 2 shows a section view along the line A-A' of the operation of a micro-fabricated externally wetted electrospray ionisation source with an integrated pneumatic nebuliser.
Figure 3:
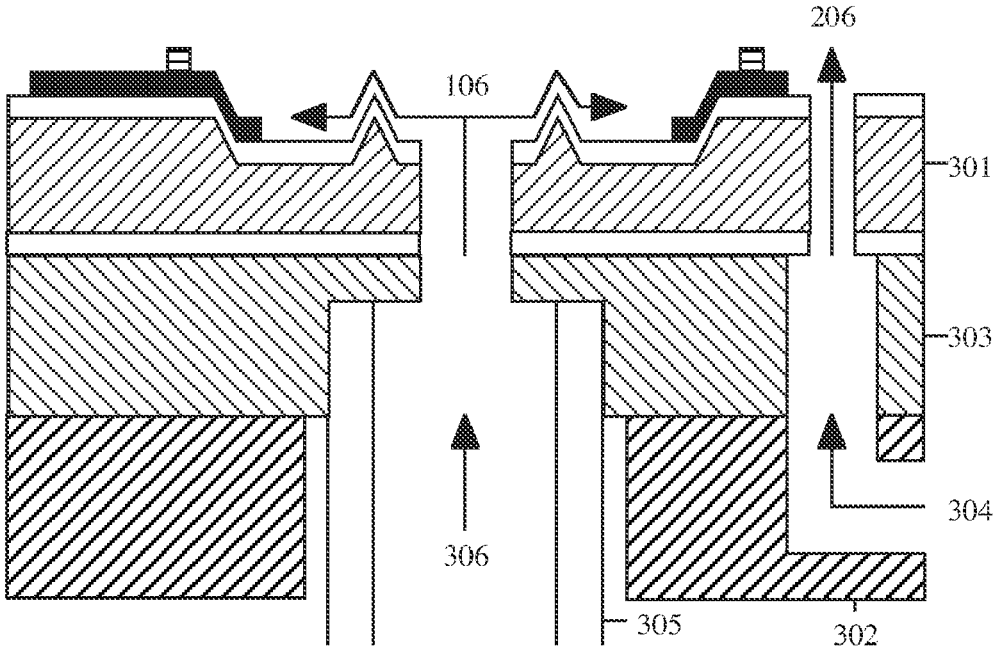
FIG. 3 shows a section view along the line A-A' of a mounting supplying both nebuliser gas and analyte liquid.

FIG. 2 shows a section view along the line A-A' of the operation of a micro-fabricated externally wetted electrospray ionisation source with an integrated pneumatic nebuliser. In this case, delivery of the liquid 106 is assumed to be from the rear of the substrate 101, passing through the etched channel 107 described above with reference to FIG. 1 so as to pass from the second side to the first side. The substrate 101 is coated with a layer 201 that can be wetted by the liquid, so that it can flow over the proud features 105 to contact the confining surface electrode 108. However through the arrangement provided on the top surface of the substrate, the liquid is confined within the hydrophobic ring 111.

A potential difference derived from a voltage source 202 is applied between the electrode contact 109 and an external electrode 203. The external electrode typically contains at least one aperture 204 to allow ions to pass through to a subsequent analytic device. Examples of subsequent devices include mass spectrometers with atmospheric pressure ion sampling.

The potential difference is sufficiently large that the liquid film coating each proud feature 105 may be drawn out into a Taylor cone. Each proud feature may then emit a stream of ions 205 by electrospray, and the combined ion stream will thereby present a concentrated flux of electrosprayed ions. In this way, the plurality of proud features generates a multiemitter. A flow of gas 206 may be passed from the rear of the substrate to the front via the etched slot 103, thus providing a concentric flow of gas around the ion streams to promote nebulisation and hence to further enhance the overall ion flux.

Thus it will be appreciated that the overall construction described provides an exemplary method of combining a set of externally wettable electrospray emitters, a contacting electrode, a channel for a concentric gas flow and a liquid input channel on a planar substrate.

It will also be appreciated that the arrangement shown is representative and not restrictive. For example, different numbers of externally wettable emitters may be used, with different sizes, spacing and general arrangement to that shown, without departing from the present teaching. In general the spacing of the externally wettable emitters will be chosen to provide a close packed array, so that a large ion density is achieved, and the number will be chosen to provide an emission rate matching the rate of delivery of the liquid analyte.

It will also be appreciated that different numbers of substrate sections may be used to support the central table, with different sizes, spacing and general arrangement to that shown. In general, the arrangement of these sections will be chosen to provide a mechanical restraint against the nebuliser gas flow and to allow one or more electrical pathways between the conducting surface electrode and contact pads on the substrate.

It will also be appreciated that the gas flow channel will typically at least partially surround the central table, so that a mainly concentric flow of nebuliser gas may be provided. The gas flow may be delivered as shown in the example arrangement of FIG. 3. Here the electrospray source 301 is attached to a mounting 302 by a planar gasket 303, which provides a gas and liquid tight seal therebetween. Suitable gasket materials include the elastomer polydimethyl-siloxane (PDMS) which may conveniently be formed into a wide range of shapes by casting or moulding, and which may form a secure bond to a wide range of materials including silicon and silica after suitable surface treatment. The arrangement may provide an input channel for a stream of nebuliser gas 304.

It will also be appreciated that the liquid input channel will desirably be placed at the centre of the array of proud features, so that the time taken for the liquid to flow over the proud features is minimised. In this case, peak-broadening effects will be reduced when the liquid analyte is derived from a pre-separation device such as a liquid chromatography system. The liquid flow may also be provided as shown in the example arrangement of FIG. 3. Here the planar sealing gasket is arranged to provide a socket for mounting a capillary 305 carrying the flow of liquid 306.

Figure 4:
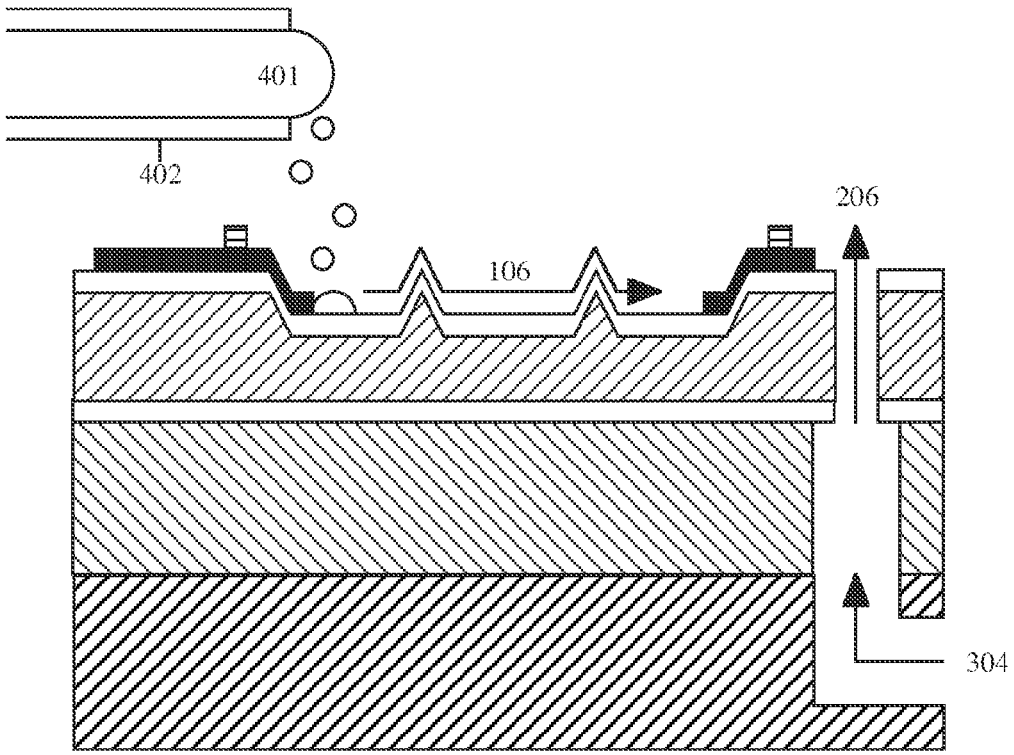
FIG. 4 shows a section view along the line A-A' of a mounting supplying a nebuliser gas, with the analyte liquid being applied externally.

It will also be appreciated that under some applications it may be desirable to omit the liquid channel, and instead deliver the analyte liquid directly to the front side of the device. FIG. 4 shows an arrangement where the surface coating liquid 106 is dispensed as droplets from a liquid analyte 401 contained in a capillary 402. This arrangement may be particularly convenient when more than one electrospray source is being used in conjunction with more than one liquid analyte, the liquids being supplied from capillaries for example by a robotic sampler.

Figure 5A:
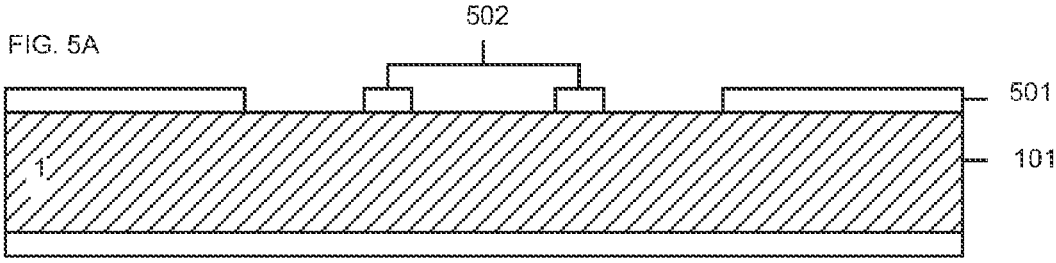
FIG. 5A illustrates step 1 of the process.
Figure 5B:
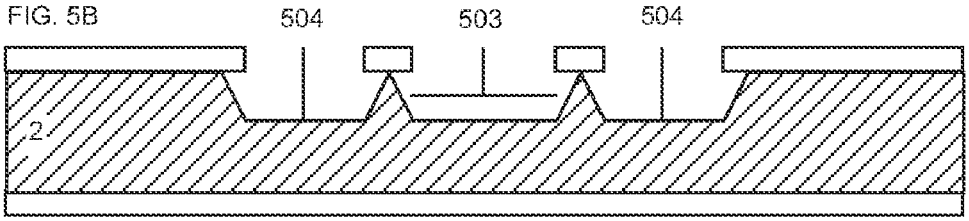
FIG. 5B illustrates step 2 of the process.
Figure 5C:
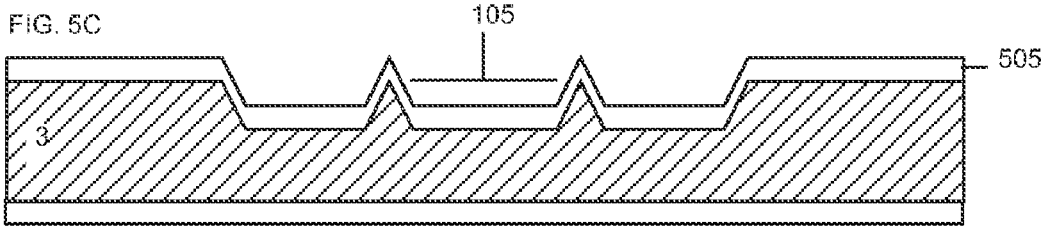
FIG. 5C illustrates step 3 of the process.
Figure 6:
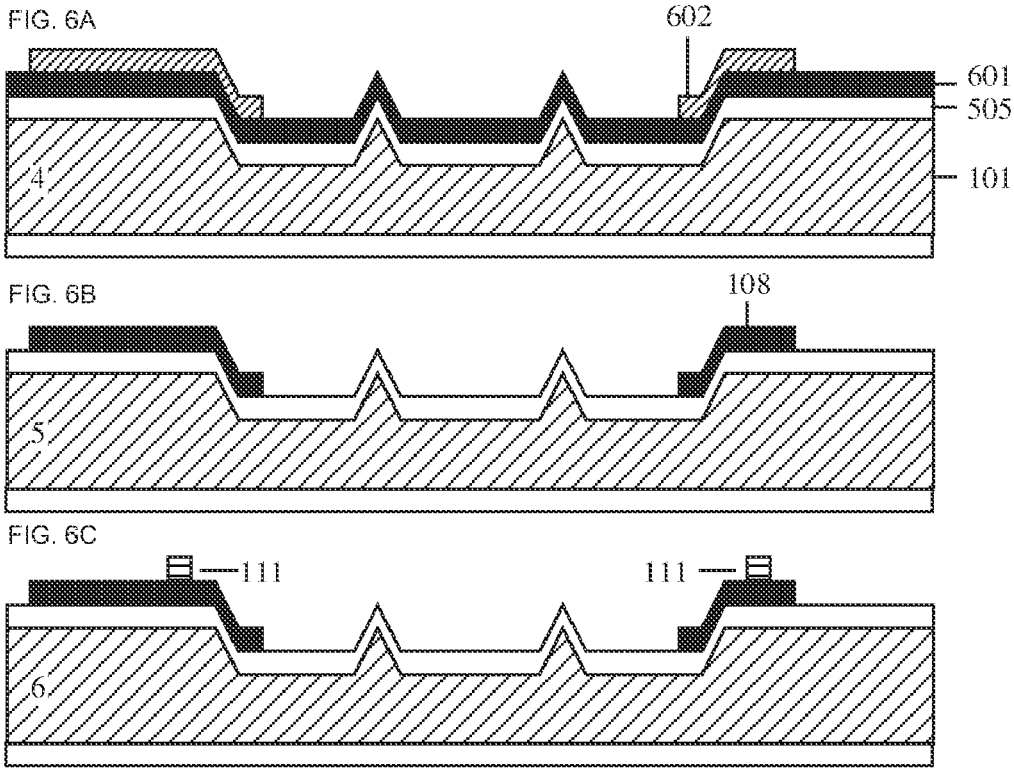
Figure 7:
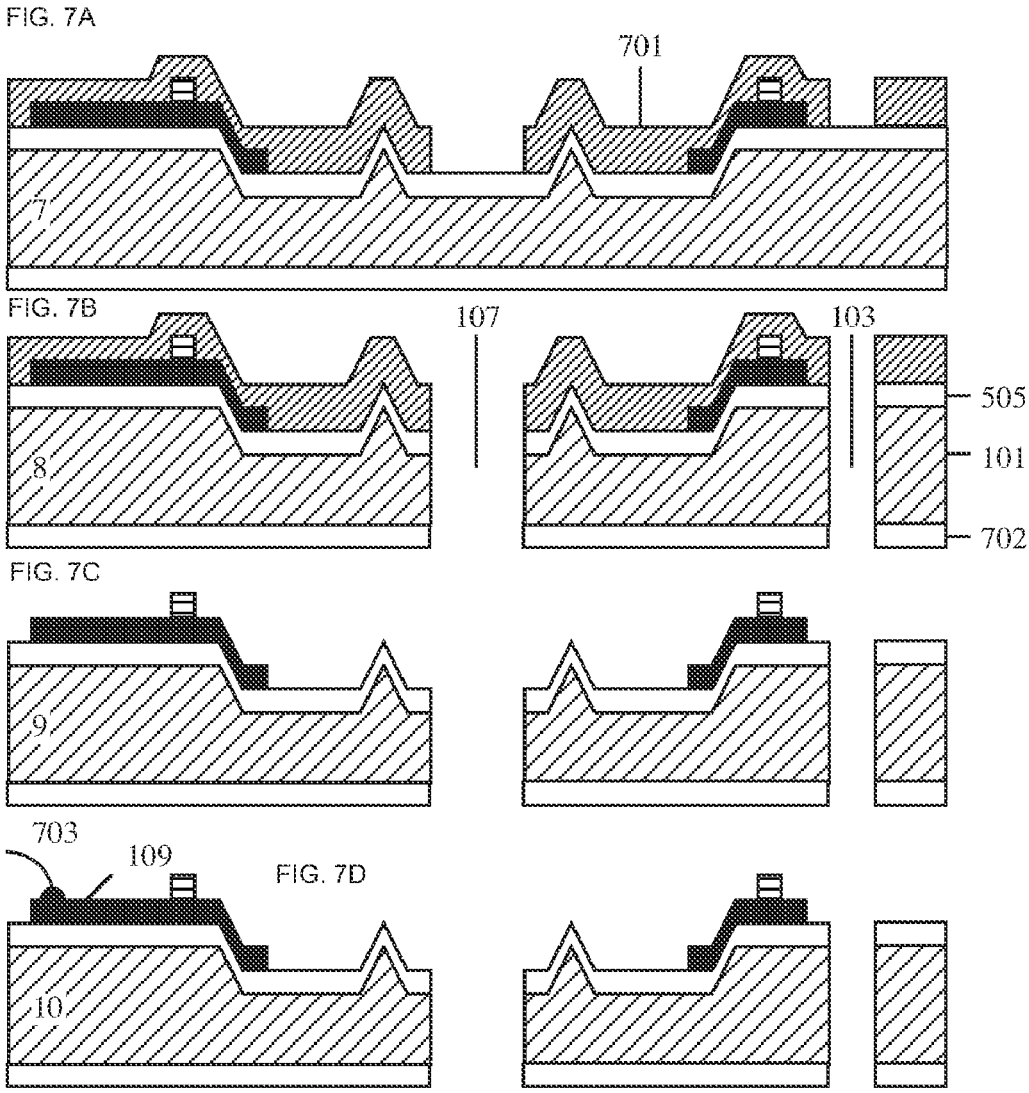

FIGS. 5-7 show an exemplary construction of the device of FIGS. 1 to 4 using standard micro-fabrication methods, using a silicon substrate as a starting material.

FIG. 5 shows a method of forming an array of proud features with a wettable surface. In step 1, a silicon substrate 101 is first coated in a layer of masking material 501, which is patterned to define a set of masking features 502, each masking feature being placed at the desired location of one proud feature. Suitable masking layers include photoresist patterned using optical lithography, and silicon dioxide patterned by reactive ion etching using an additional surface mask of photoresist patterned by lithography.

In step 2, the exposed silicon surface is etched, using a process that etches laterally as well as vertically, so that the mask layer is undercut and a set of proud features 503 with a tapered profile surrounded by wells 504 is formed. Suitable etching methods for a silicon substrate include isotropic reactive ion etching, using plasma containing $SF_6$ gas [Ji 2006]. The dimensions of the masking features and the etching time are chosen so that the proud features are formed with a suitable height and a suitable tip diameter. Depending on the relative isotropy of the etching process, the proud features may be in the form of cone shapes with different apex angles, or have a surface that has more than one radius of curvature.

In step 3, the surface mask is removed, and the silicon is coated with a thin layer of a wettable material 505 to form the wettable proud features 105. Suitable wettable materials include silicon dioxide, and suitable layer deposition methods include thermal oxidation, chemical vapour deposition and plasma enhanced chemical vapour deposition. Methods of enhancing the wettability of silicon dioxide include immersion in water for a period of time.

FIG. 6 shows a method of forming a contact electrode with a hydrophobic barrier. In step 4, the front hydrophilic layer 505 of the substrate 101 is conformally coated with a layer of conducting metal 601, which is then coated in a layer of masking material 602 that defines a set of electrode features. Suitable conducting materials include noble metals such as gold, and suitable deposition methods include radio frequency sputtering. Suitable masking materials include photoresist patterned by lithography.

In step 5, the conducting layer is etched to transfer the pattern of the surface mask 602 into a set of corresponding conducting features such as the contacting electrode 108 in the underlying conducting layer. The surface mask is removed to leave the surface of the device exposed.

In step 6, further lithography is carried out to incorporate three-dimensional hydrophobic features to restrict wetting in the case when large volumes of liquid are dispensed and confine any surface wetting liquid to the vicinity of the proud features. An additional layer of a hydrophobic polymer is deposited and patterned using lithography into the shape of a dam 111 surrounding the region of the table containing the proud features. Suitable photopatternable hydrophobic polymers include the permanent epoxy photoresist SU-8 [Lorenz 1997].

FIG. 7 shows a method of forming the gas flow channel, and also a liquid flow channel if desired. In step 7 the surface of the device is coated with a layer of masking material 701 that defines a set of channels. Suitable masking materials include a thick layer of photoresist patterned by lithography.

In step 8, the hydrophilic layer 505 and the substrate 101 are sequentially etched to transfer the pattern of the surface mask into a corresponding set of channels, for example a gas flow channel 103 and also a liquid flow channel 107 if desired. An additional surrounding channel may also be cut round the majority of the device, so that the device may be separated from the wafer by fracturing a short section of silicon, without the need for dicing. Any rear coating 702 that might have been deposited during oxidation is also etched sequentially using the same mask pattern and an appropriate etching method. Suitable etching methods for a hydrophilic layer based on silicon dioxide include anisotropic reactive ion etching using plasma containing a mixture of $CHF_3$, $O_2$ and Ar gases. Suitable etching methods for a silicon substrate include deep reactive ion etching in a high-density plasma using a process such as the one developed by Robert Bosch GmbH [U.S. Pat. No. 5,501,893; Hynes 1999]. This process is based on alternating cycles of silicon etching using plasma containing $SF_6$ and $O_2$ and of sidewall passivation using plasma containing $C_4F_8$ gas.

In step 9, the surface mask is removed to leave the surface of the device exposed. In step 10, the device is cleaned, separated from the rest of the wafer, and a bond wire 703 is attached to the contact pad 109 to allow application of an electrical potential.

The fabrication process described above is intended to be exemplary, and for use with a silicon starting substrate. It will be appreciated to those knowledgeable in the art of microfabrication that the order of the individual process steps may be permuted to yield a similarly compatible process without substantially altering the final result, and that other equivalent process steps may be used to replace the process steps described.

For example, different etching processes may be substituted to form the proud features using a surface mask. Examples include isotropic wet chemical etching of silicon [Robbins 1959], anisotropic wet chemical etching of silicon [Lee 1969], and anodic etching of silicon [van den Meerakker 2003]. Other methods of etching may also be used that form large numbers of proud features without the need to mask each feature separately, for example the 'black silicon method' which can form a rough or grassy silicon surface by careful choice of the etching conditions [Jansen 1995]. Different processes may also be substituted to etch the silicon channels. Examples include cryogenic deep reactive ion etching.

Different coating processes may be substituted to form a hydrophilic silicon dioxide layer. Examples include RF sputtering of $SiO_2$ and anodic oxidation. Different etching processes may be substituted to etch the silicon dioxide layer(s). Examples include wet chemical etching in buffered HF.

It will be apparent to those skilled in the art that other processes may be used with different starting materials, to yield a similar final object. For example, the main structural features may be formed by replica moulding of a plastic or a ceramic, or by electroplating a metal inside a mould. In each case the master may conveniently be formed using silicon-based planar processing. A hydrophilic silicon dioxide coating may then be incorporated, using RF sputtering. Similarly, a contacting electrode structure may be formed by evaporation of a metal through a stencil.

It will also be appreciated that whatever process is used for fabrication, a plurality of similar externally wettable electrospray sources may be constructed as an array. Such arrays may used in applications where different sources are required to spray different analytes in turn, or where redundancy is required to allow for the possibility of device failure.

It will be understood that what has been described herein are exemplary embodiments of an ionisation source comprising a pneumatic nebuliser to enhance ion flux. Such a source has application in a number of different fields, exemplary applications having been described with reference to mass spectrometry. It will however be understood that it is not intended to limit the present invention in any way except as may be deemed necessary in the light of the appended claims.

Within the context of the present invention the term microengineered or microengineering or micro-fabricated or microfabrication is intended to define the fabrication of three dimensional structures and devices with dimensions in the order of microns. It combines the technologies of microelectronics and micromachining Microelectronics allows the fabrication of integrated circuits from silicon wafers whereas micromachining is the production of three-dimensional structures, primarily from silicon wafers. This may be achieved by removal of material from the wafer or addition of material on or in the wafer. The attractions of microengineering may be summarised as batch fabrication of devices leading to reduced production costs, miniaturisation resulting in materials savings, miniaturisation resulting in faster response times and reduced device invasiveness. Wide varieties of techniques exist for the microengineering of wafers, and will be well known to the person skilled in the art. The techniques may be divided into those related to the removal of material and those pertaining to the deposition or addition of material to the wafer. Examples of the former include:

Wet chemical etching (anisotropic and isotropic)
Electrochemical or photo assisted electrochemical etching
Dry plasma or reactive ion etching
Ion beam milling
Laser machining
Excimer laser machining Whereas examples of the latter include:

Evaporation
Thick film deposition
Sputtering
Electroplating
Electroforming
Moulding
Chemical vapour deposition (CVD)
Epitaxy These techniques can be combined with wafer bonding to produce complex three-dimensional, examples of which are ionisation source devices as heretofore described.

Where the words "upper", "lower", "top", bottom, "interior", "exterior" and the like have been used, it will be understood that these are used to convey the mutual arrangement of the layers relative to one another and are not to be interpreted as limiting the invention to such a configuration where for example a surface designated a top surface is not above a surface designated a lower surface.

Furthermore, the words comprises/comprising when used in this specification are to specify the presence of stated features, integers, steps or components but does not preclude the presence or addition of one or more other features, integers, steps, components or groups thereof.

The invention claimed is:

1. An electrospray pneumatic nebuliser ionisation source comprising a substrate having a first side and a second side, the first side comprising at least one proud wettable feature defined thereon, the proud feature being in electrical contact with an electrode, the source additionally comprising a channel extending from the second side through to the first side for transport of a nebuliser gas to the first side.

2. The source of claim 1 comprising a table defined on the first side, the at least one proud wettable feature being provided on the table.

3. The source of claim 1 wherein the first side is wettable so as to allow for the flow of a liquid across the first side to the at least one proud wettable feature.

4. The source of claim 1 wherein the at least one proud wettable feature has a tip diameter less than 50 microns.

5. The source of claim 1 wherein the substrate is wettable by a liquid analyte so operably an analyte can be provided to wet the at least one proud feature.

6. The source of claim 1 wherein the at least one proud wettable feature is configured to concentrate an electric field.

7. The source of claim 1 configured for operable use with a second electrode, the second electrode being remote from the first electrode and wherein the first and second electrodes operably cooperate to define an electric field therebetween.

8. The source of claim 1 wherein the electric field operably effects generation of a Taylor cone extending from the at least one proud feature.

9. The source of claim 8 comprising a plurality of proud features, each feature operably having a Taylor cone extending therefrom to emit a flux of ions by electrospray.

10. The source of claim 1 wherein the channel extends at least substantially about the perimeter of the at least one proud feature.

11. The source as claimed in claim 10 wherein the channel extends fully about the perimeter of the at least one proud feature.

12. The source of claim 1 comprising a plurality of proud features arranged in an array, and wherein the channel extends at least partially about the perimeter of the array.

13. The source as claimed in claim 12 wherein the channel extends fully about the perimeter of the array.

14. The source of claim 1 wherein the channel is provided relative to the at least one proud feature such that operably the channel provides a gas flow that is coaxial to the electrosprayed ion flux so as to provide a pneumatic nebuliser.

15. The source of claim 1 wherein the channel is configured such that operably the transported gas flow is at least partly annular and at least partly surrounding the electrosprayed ion flux.

16. The source of claim 1 further comprising a second channel extending from the second side of the substrate to the first side of the substrate, the second channel operably providing for transport of a liquid analyte.

17. The source as claimed in claim 16 comprising a plurality of proud features and wherein the second channel is centred amongst the proud features, to minimise the time taken by the liquid to reach each proud feature.

18. The source of claim 1 being configured for direct supply of the liquid analyte to the first side of the substrate.

19. The source of claim 1 in which the substrate material is silicon.

20. The source as claimed in claim 19 wherein wettable portions of the first side are defined by provision of a surface layer of silicon dioxide on those portions.

21. The source of claim 1, in which the proud features are formed by an etching process.

22. The source of claim 1 in which the first channel is formed by etching.

23. The source of claim 1 comprising a surface barrier extending between a wettable portion and a non-wettable portion of the first side, the surface barrier operably containing a liquid analyte within the wettable portion.

24. The source of claim 23 comprising a table defined on the first side, the at least one proud wettable feature being provided on the table.

25. The source of claim 24 wherein the surface barrier extends at least partially about the table so as to contain liquid to that table portion of the first side.

26. The source of claim 23 wherein the surface barrier is a polymer.

27. The source of claim 1 wherein the substrate is fabricated in plastic or ceramic or metal with portions of the substrate coated with a wettable material to define wettable portions of the source.

28. The source as claimed in claim 27 wherein the substrate is a moulded substrate.

29. An electrospray ionisation array comprising a plurality of sources as claimed in claim 1 arranged relative to one another to define the array.

* * * * *